US005357261A

United States Patent [19]

Brandigampola

[11] Patent Number: 5,357,261

[45] Date of Patent: Oct. 18, 1994

[54] ANTENNA FOR MATCHED TRANSMISSION SYSTEM

[76] Inventor: Don E. Brandigampola, 131 Dimson Ave., Guelph, Ontario, Canada, N1G 3C5

[21] Appl. No.: 27,647

[22] Filed: Mar. 8, 1993

[51] Int. Cl.[5] ..... H01Q 9/30; H01Q 1/32

[52] U.S. Cl. ..... 343/900; 343/715; 343/888

[58] Field of Search ..... 343/900, 715, DIG. 1, 343/895, 904, 906, 878, 884, 888; H01Q 9/30, 1/32

[56] References Cited

U.S. PATENT DOCUMENTS

| | | | |
|---|---|---|---|
| 3,725,944 | 4/1973 | Valeriote, Jr. | 343/900 |
| 4,300,140 | 11/1981 | Brandigampola | 343/900 |
| 4,500,888 | 2/1985 | Brandigampola | 343/900 |

FOREIGN PATENT DOCUMENTS

| | | | |
|---|---|---|---|
| 748318 | 4/1956 | United Kingdom | 343/DIG. 1 |

*Primary Examiner*—Donald Hajec
*Assistant Examiner*—Hoanganh Le

[57] ABSTRACT

A free standing antenna for use in associations with high-stress environments subjecting the antenna to extremes of flexing stress and temperature stress and chemical stress, the antenna having a mounting base portion which can be secured to a base adjacent to the high-stress environment, the base member being formed of glass fibre reinforced resin materials containing fibres extending in a longitudinal direction, along the axis of the base, and further fibres running in a generally annular fashion in planes generally transverse to the axis, and the base member further defining a fastening flange, a plurality of fastening holes formed in the flange, a generally tapering neck portion extending upwardly from the fastening flange, and a generally cylindrical junction head extending upwardly from the neck, the head and the neck being located along a common central axis, and an antenna column secured to the cylindrical head, the column being formed of hollow tubular metal defining outer and inner wall surfaces, and progressively tapering from a larger end to a smaller end, and a cylindrical junction portion at the wide end which makes a snug fit over the generally cylindrical head portion of the base, at least three electrical connections secured to the column portion adjacent the base, at spaced apart points therealong, to which electrical connections may be made by radio equipment, a generally dome shaped cap secured to the smaller end of the column portion, and, a damping weight secured within the interior of the column spaced below the cap.

6 Claims, 3 Drawing Sheets

ANTENNA FOR MATCHED TRANSMISSION SYSTEM

FIELD OF THE INVENTION

The invention relates to antennas for use in radio transmission and receiving systems, and in particular, to matched antennas for such radio transmission systems which are used on marine vessels.

BACKGROUND OF THE INVENTION

In the radio transmission art, it is well known that the effective length of the antenna must be "matched" to the transmission wave length. This is understood to mean that for a given wave length of radio transmission, the antenna must have an optimum length. Thus, in some transmission systems, it is the practice to vary the length of the antenna in order to match it to the transmission.

However, in the great majority of radio transmission systems, this is not practical. What is in effect done is that an antenna of a predetermined average length is provided, and an electronic matching circuit is provided between the transmitter and the antenna, so that, the apparent length of the antenna can be matched to the wave length actually being transmitted. Again, this is relatively well known.

For the purposes of this explanation the term "radio transmission system" is deemed to include either the radio transmitter, or receiver, or both. Matched antennas are often required for both for transmitting and receiving.

In the marine radio transmission art, one of the complicating factors is that it is highly desirable to provide what are known as "whip" antennas. A whip antenna is defined as an antenna which is fastened only at its base, and is essentially free-standing, without the intervention of any supports such as guy wires or the like.

In order to withstand the motion of a marine vessel at sea, particularly during high winds and rough weather, such whip antennas must have a certain degree of flexibility, so as to permit them to withstand the extreme motion of the vessel itself.

Some particularly effective forms of whip antenna design are described in U.S. Pat. Nos. 3,725,944, 4,300,140, and 4,500,888, all of which have been assigned to Valcom Ltd.

These whip antennas are constructed of fibreglass, and the longer versions of such antennas are constructed in sections which can be put together, somewhat in the manner of a fishing rod. Conductors are located within the body of the antenna carrying the radio signal up or down the length of the antenna.

Such whip antennas, made in accordance with these patents and have proved to be highly effective in use, and are widely used for marine purposes, particularly by military and naval vessels in various countries of the world.

However, due to the increasing crowding of the air waves by an increasing volume of radio signals, and also to a certain extent due to the requirements of security, it is desirable to provide for a radio transmission system on a marine vessel which will operate over a relatively wide band width. Desirably, such a radio transmission system may be capable of operating over band widths of from two megahertz to thirty megahertz. At present, it is not possible in this wide frequency range to provide a single antenna which can be matched to all of the transmissions over this wide band width. In the past, when somewhat narrower band widths may have been satisfactory, it was the practice to provide two pairs of whip antennas on a vessel. One pair would be mounted towards the bow, and the other pair of antennas mounted towards the stern of the vessel, in a typical case. By a suitable selection of the lengths of the antennas in the two pairs, it was possible to provide a reasonable degree of matching over the then acceptable band width for transmission and/or reception.

Alternatively one pair might be used for transmitting, and the other pair for receiving.

However, increasingly greater band widths are now required for transmissions, and greater and greater demands are made on the transmission systems, both for greater range and also for clarity of transmission, and for security.

It is also desirable to be able to switch bands relatively quickly, and this band switching may take place even within the space of a single message transmission.

When two pairs of antennas were regarded as satisfactory, it was the practice to provide one pair of shorter antennas and one pair of longer antennas. The antennas in their respective pairs acted as dipoles, so that they could be matched to handle a reasonable range of band widths of transmission or reception, within the limitations of their own lengths.

However, as mentioned above, due to the increasingly strict demands being made upon such radio transmission systems, it is no longer adequate to provide simply two pairs of whip antennas for any one radio system.

Requirements now call for the provision of three separate pairs of whip antennas. Each pair of antennas must be securely and substantially permanently attached at its location, i.e. to the vessel, and, bearing in mind the complexity and amount of other equipment which is also carried on such vessels, it has become increasingly difficult to find suitable locations for positioning the three pairs of antennas, particularly on smaller vessels. While there is relatively little problem in locating one pair of antennas near the bow, and another pair towards the stern, it is generally necessary to mount the third pair of antennas more or less amidships to the vessel.

The antennas must be mounted so that the two antennas in any one pair are no more than about ten feet apart from one another, in order to achieve the desired dipole effect.

While this does not present any serious problems, with the antennas mounted towards the bow and towards the stern, it does present problems with regard to the pair of antennas which are now required to be mounted amidships. Usually, the vessel will have one or more smoke stacks, emitting fumes or exhaust from the engines, and usually the smoke stack will also be located amidships. The fumes or exhaust as they leave the smoke stack may well be at a temperature in the region of six hundred or more degrees Fahrenheit and contain harmful chemicals. If antennas made of glass fibre reinforced resin materials are placed in close juxtaposition to the smoke stack, they will be unable to withstand these high temperatures and chemical emissions and the resin material will soon be degraded.

An additional, although not so serious a problem, was presented by the degree of flexibility incorporated in antennas made of glass fibre reinforced resins. Antennas made of such material were capable of relatively extreme degrees of deflection in high winds or during violent motion of the vessel in rough water. Depending upon where the antennas were placed, and how close to the smoke stack the antennas were located, it was conceivable that during extreme weather the antennas might contact the smoke stack and be damaged.

Accordingly, it is desirable to provide antennas which are both resistant to chemical emissions and to much higher temperature gases than are antennas made of glass fibre reinforced material, and which are also possessed of a higher degree of stiffness, making them more resistant to bending during extreme weather conditions. Antennas having such improved physical properties can then be mounted immediately alongside the smoke stack of a vessel, without fear of damage due to chemicals or to high temperature gases, and without fear that they will interfere with the smoke stack during extreme weather.

BRIEF SUMMARY OF THE INVENTION

With the view therefore to overcoming the various conflicting problems described above, the invention comprises a free standing antenna for use in association with high-stress environments, said environments subjecting said antenna to extremes of stress including flexing stress and temperature stress, and said antenna comprising a mounting base member adapted to be secured to a base adjacent to said high-stress environment, said base member being formed of glass fibre reinforced resin materials containing fibres extending in a longitudinal direction, along the axis of said base, and further fibres running in a generally annular fashion in planes generally transverse to said axis, and said base member further defining a fastening flange, a plurality of fastening holes formed in said fastening flange, a generally tapering neck portion extending upwardly from said fastening flange, and a generally cylindrical junction head extending upwardly from said neck portion, said head and said neck portion being located along a common central axis, and an antenna column portion secured to said cylindrical head, said antenna column portion being formed of hollow tubular metal defining outer and inner wall surfaces, and progressively tapering from a larger end to a smaller end, and a cylindrical junction portion at said wide end adapted to make a snug fit over said generally cylindrical head of said base member, three electrical connections means secured to said column portion adjacent said base, at spaced apart points therealong, whereby electrical connections may be made thereto by radio equipment, a generally dome shaped cap secured to said smaller end of said column portion, and, damping weight means secured within said column portion adjacent to but spaced from said cap, said damping means being secured within the interior of said hollow metal tube.

The invention further comprises such an antenna, wherein said column portion comprises at least two separate first and second column portions, each of said column portions defining larger lower ends and smaller upper ends, and said first column portion at said smaller end defining a generally cylindrical column junction section, and said second column portion defining, at said larger end, a generally cylindrical column junction sleeve adapted to make a snug fit over said column junction section, and, reinforcing ring means secured inside said column junction section at spaced apart intervals, and fastening opening means formed in said column junction sleeve in registration with said reinforcing rings, whereby fastenings may be passed therethrough and secured into said reinforcing rings, thereby joining said first and second column portions together.

The invention further comprises such an antenna and including an axial opening in said base extending therealong from the top of said junction head portion, to said flange, and, drain conduit means formed in the underside of said flange, whereby liquid within said base or said column may drain downwardly and outwardly therefrom.

The invention further comprises such an antenna and including reinforcement ring means in said cylindrical head, and fastening openings therethrough, whereby fastenings can be passed from said cylindrical junction portion at said wide end of said antenna column portion, and said cylindrical head of said base member, and through said reinforcement ring means.

The invention further comprises such an antenna and including at least two collar members formed on the exterior or said base member, axially spaced therealong, on said neck portion, below said generally cylindrical junction head.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 6:
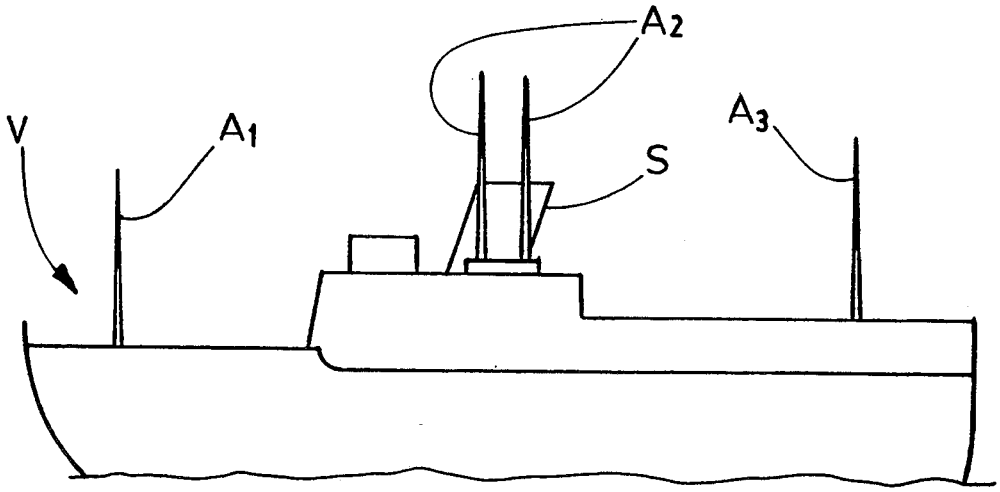
FIG. 6 is a side elevation of a typical marine craft, illustrating three pairs of antennas erected thereon.

Referring first of all to FIG. 6, it will be seen that the invention in this particular embodiment is illustrated in the form of an antenna for use on a marine vessel. The circumstances in the environment of a marine vessel have already been described above. It is sufficient to say that antennas on marine vessels are subject to extremes of environmental stress both at physical stress due to the violent motion of the vessel, and also chemical and temperature stress, due to the emissions from the smoke stack of the engine of the vessel.

It will be observed that on the vessel indicated generally as V, there are three pairs of antennas indicated respectively as A1, A2, and A3, mounted respectively in pairs at or adjacent to the bow, amidships, and towards the stern of the vessel, respectively.

All six of the antennas are of course subjected to the same extremes of physical stress during rough weather.

However, the center pair of antennas A2 located amidships are located closely alongside the smokestack S of the vessel V.

It is not possible to locate the antennas far enough apart so that they will be distanced from the smokestack to avoid the emissions from the smokestack. In the first place the emissions from the smokestack are liable to blow in any direction depending upon the wind and/or direction of movement of the vessel. In the second place, the respective pairs of antennas A1, A2, and A3 are required to function in pairs as "dipoles", for reasons which will be apparent to those skilled in the art, and which require no special description. In order to function in this way, it is desirable that the antenna pairs be mounted adjacent to one another, preferably no more than ten feet apart.

It will also be observed that the pairs of antennas A1, A2, and A3 are of varying lengths. In this way, it is possible for the radio transmission/reception unit on the vessel V to select for its transmission either the antennas A1, or A2, or A3, depending upon the particular transmission wave length being transmitted (or received) at the moment, for example, and for other reasons understood in the art.

In this way, it is possible for the radio transmission (or reception) to be switched rapidly from one pair of antennas to the other and back again, and so on. Antenna matching units (not shown) are adjustable in known manner, so as to tune the selected pair of antennas, so as to be as closely as possible matched to the wavelength of the transmission being emitted (or received) at that particular moment by the radio transmission/reception unit.

In this way, it is possible for the radio transmission/-transmission on a vessel to be switched at relatively short time intervals from one wave length to another and back again and so on throughout a single transmission. Alternatively, if for some reason it is desirable to transmit at a particular frequency, then that of course can also be performed by the transmission unit. Typically shorter wavelengths will be used for communications from vessel to vessel which are adjacent to one another, and longer wave lengths will be used for transmission to vessels which are further apart, or for transmission to/or from, for example, a land based station, and back again.

These remarks are essentially generalities, and these factors are well understood to persons skilled in the art, and are included here merely for the sake of illustrating the way in which the invention is used.

It will thus be seen that at least in the case of the antennas A2, for being placed closely just opposed either on one side of the smokestack (or on either side), they are not only subjected to the physical stress of the movement of the vessel, but they are also subjected to the severe heating and chemical stress caused by the hot emissions from the closely adjacent smoke stack.

The antennas in accordance with the invention are therefore designed and specified to function effectively under these extreme conditions of stress, without degradation, and without flexing into contact with the smoke stacks.

The antennas according to the invention are illustrated more specifically in association with FIGS. 1 to 5. Before describing these figures, it will be understood that depending upon the length of the antenna required they may be made either as a single length, or in two lengths, or in some cases three or more separate lengths, connected together to form a single extended antenna. For the purposes of this invention, and for simplicity in explanation, FIGS. 1 through 5 illustrate an antenna constructed in two lengths. It will however be appreciated that the invention is not solely limited thereto but comprehends both a single length, and three or more lengths of antenna, as the case may require.

Figure 1:
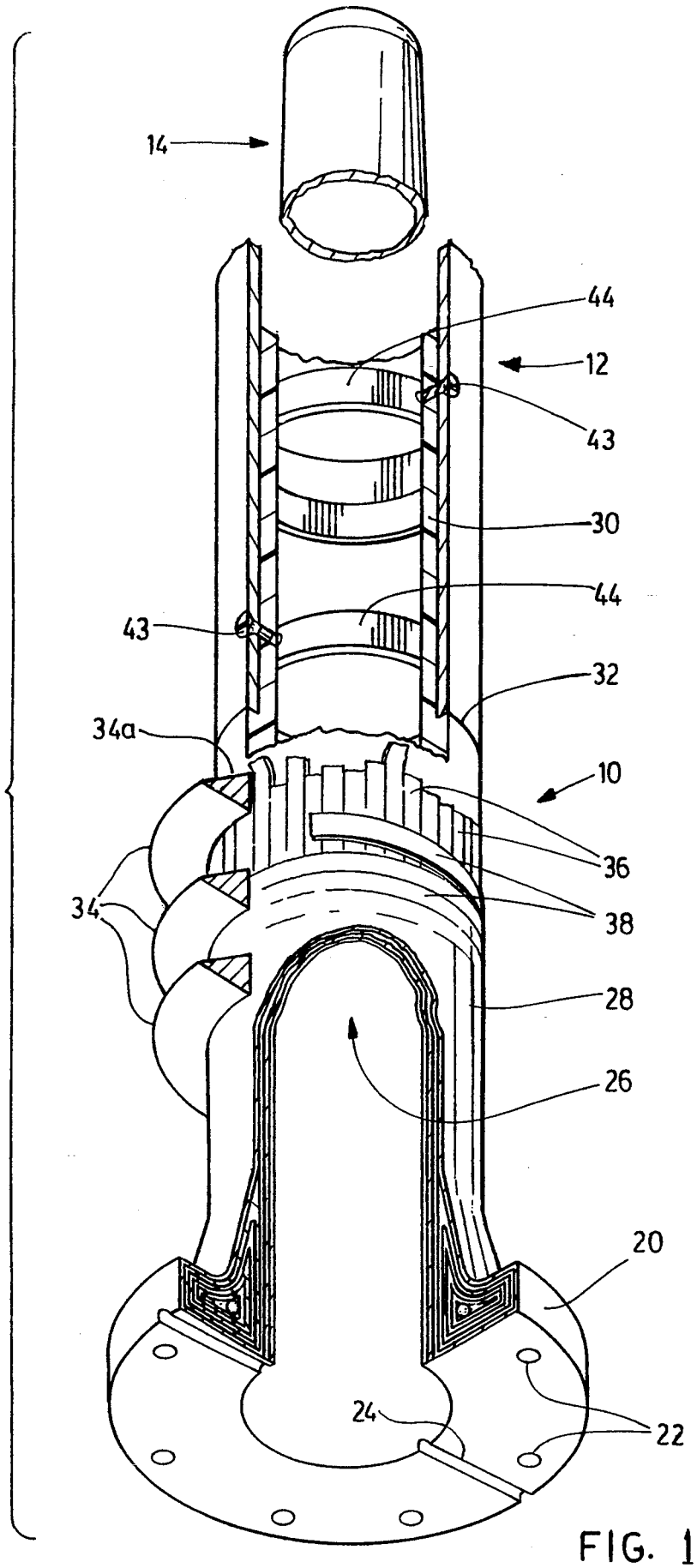
FIG. 1 is a perspective illustration of an antenna in accordance with the invention, shown partially cut away.

In FIG. 1, the antenna will thus be seen to comprise three components, namely a base indicated as 10, a lower first antenna column portion 12 and an upper second antenna column portion 14.

Figure 2:
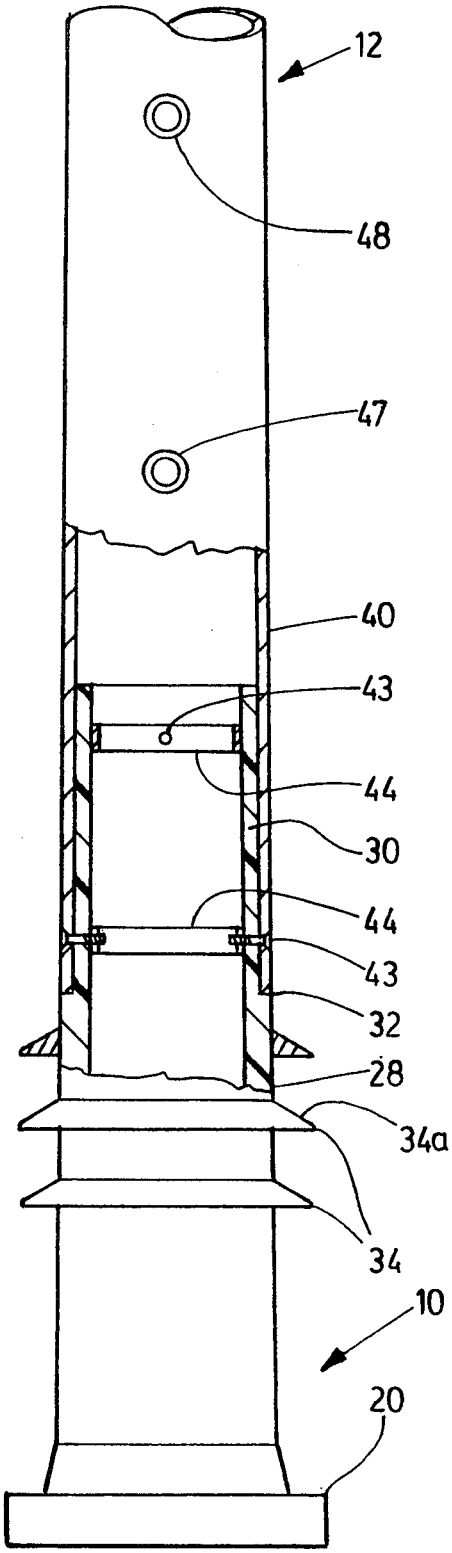
FIG. 2 is a partial section along the line 2—2 of FIG. 1 illustrating the base.
Figure 3:
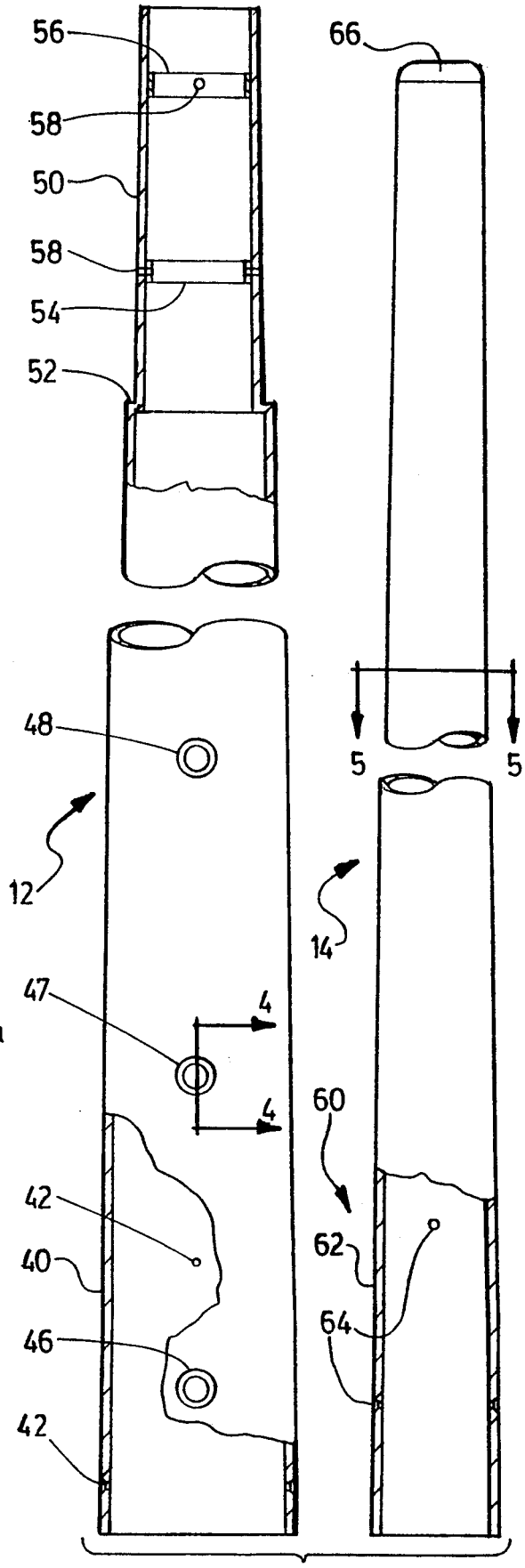
FIG. 3 is an elevation of one antenna, exploded and partially cut away, and illustrating the details of both of the column portions.
Figure 4:
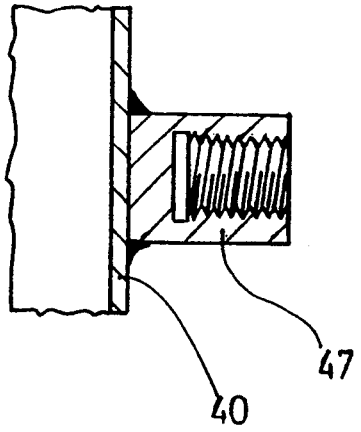
FIG. 4 is a section along line 4—4 of FIG. 3 illustrating a connector in detail.

As illustrated in FIG. 2, the base comprises a flange 20, having a plurality of bolt holes 22 formed therein by means of which it may be secured to a mounting position for example on the deck of a vessel or the like. In addition, on the underside of the flange 20, there are drainage passageways 24, extending thereacross, communicating with the central interior axial opening 26.

The base 12 also comprises a generally tapering neck portion 28 extending upwardly from the flange, and a generally cylindrical head junction portion 30 extending upwardly from the neck 28.

A shoulder 32 is formed at the junction between the head and the neck.

As generally illustrated, the entire base is fabricated of glass fibre reinforced material. The reinforcing fibres are indicated as 36 and 38. The fibres 36 extend more or less longitudinally along a vertical axis, from flange 20 up into the junction head 30. Generally annular fibres 38 extend around the base intersecting the longitudinal fibres. Preferably in fact the entire structure is formed on a rotatable mandrel (not shown) so that the longitudinal fibres may be arranged in position, after which a plurality of the annular fibres may be wound therearound, and then a further quantity of longitudinal fibres arranged, and so on, thereby building up a matrix of longitudinal and annular fibres, the annular fibres being located more or less in planes which are normal to the longitudinal fibres. It will be understood that this is not precisely the case since the annular fibres are wound on so that they will in fact form a spiral configuration, but the analogy is close enough for the purposes of this explanation.

It will be noted that the generally longitudinal fibres 36 extend downwardly into the flange 20, and wrap around thereunder to form a continuous structure.

In addition, a plurality, in this case three, collars 34—34 are formed on the exterior of the neck portion 28, and define upwardly frusto-conical surfaces 34A which function to shed moisture outwardly.

It will thus be seen that the base provides a secure, and electrically insulated means of mounting an antenna, and at the same time, being of hollow construction, with interior drainage, will not result in the accumulation of any moisture that may enter, which might otherwise over a period of time, eventually cause deterioration.

As mentioned above, the particular antenna illustrated in this embodiment comprises the lower antenna section 12 and the upper antenna section 14. However as mentioned a two section antenna is described here purely for the sake of illustration and without limitation.

Thus in this particular embodiment, the lower antenna section 12 will be seen to comprise a continuous progressively tapering metal tube, drawn from high strength aluminum metal, continuously tapering from its lower end to its upper end.

At its lower end, it is of generally cylindrical shape, indicated as 40, and is adapted to make a snug fit over the head portion 30 of the base 10.

Suitable openings 42 are formed through the cylindrical portion, to receive fastenings 43, which are then received in the head 30 of the base 10.

In order to reinforce the head 30, a pair of reinforcement rings 44—44 are located embedded within the inner surface of the head 30, and are provided with suitable openings registering with openings 42, so that fastenings 43 passing from the cylindrical lower end 40 of the lower antenna column 12, may pass through the head portion and be received through the reinforcement ring, and fastened in any suitable manner such as by washers and nuts.

A plurality, in this case three electrical connection fixtures 46, 47 and 48 are secured to the exterior of the lower end 40 of the lower antenna portion 12. Such electrical connection devices comprise threaded sleeves or sockets (FIG. 4), adapted to receive threaded fastening devices such as bolts, (not shown). In this case as mentioned, there are three such separate electrical connection devices spaced one above the other along the length of the lower section 12 of the antenna.

At the upper end of the lower section 20, a reduced diameter cylindrical connection sleeve 50 is provided, defining a shoulder 52 where the transition occurs from the tapering configuration to the sleeve 50.

Within the sleeve 50 there are located a pair of reinforcement rings 54-56 preferably formed for example of aluminum. Fastening openings 58 are formed through the sleeve, and through the reinforcing ring, and are suitably threaded to receive threaded fastening devices such as bolts.

The upper column portion 14 of the antenna also comprises a continuously tapering tubular member formed of high strength aluminum material tapering progressively from its lower to its upper end. At its lower end 60, a cylindrical connection portion 62 is formed, which is adapted to make a snug fit over the connection sleeve 50 of the lower portion 12 of the antenna. Openings 64 are formed through the cylindrical portion 62 and register with openings 58 in the connection sleeve 50, whereby fastenings such as bolts (not shown) may be passed therethrough.

At the upper end of the upper section 14, a generally dome shaped cap 66 is secured, to make the antenna as far as possible weatherproof.

As mentioned, during extreme weather conditions, the antennas will be subject to relatively violent stresses, and will be flexed to and fro. In certain conditions, depending upon the frequency of roll, or pitch of the vessel, or on other conditions, the flexing of the antennas may reach a resonant frequency, at which time further flexing may cause damage.

Figure 5:
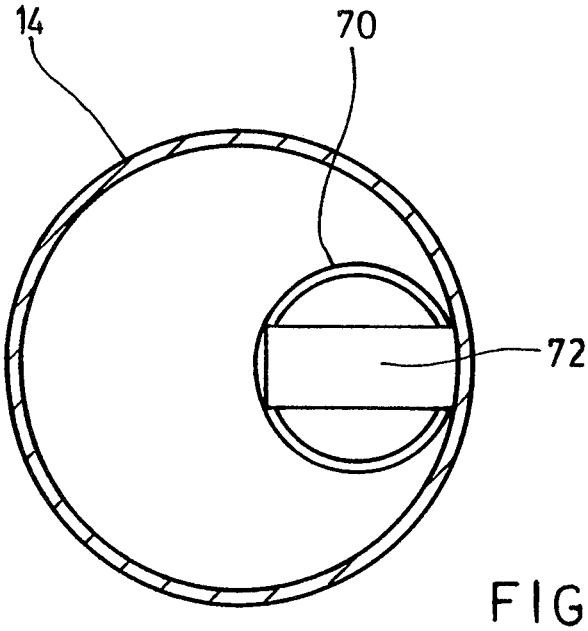
FIG. 5 is a section along 5—5 of FIG. 2 of the upper end of the second column portion, illustrating the damping device.

In order therefore to damp out such resonations, and to as far as possible eliminate resonant frequency vibration, a damping device illustrated generally in FIG. 5 is incorporated in the upper end of the upper antenna section 14. Such damping device comprises a generally cylindrical housing 70, secured by bracket 72 to the interior of the upper end of the upper portion 14 of the antenna, the central axis of the housing 70 being offset with respect to the central axis of the upper portion 14 of the antenna.

By suitably adjusting the weight of the housing 70, it effectively damps out resonant vibrations of the entire antenna.

The mode of operation and usage of the antenna in accordance with the invention is self evident from the foregoing description.

As explained, it is particularly designed for use on marine vessels, but is of general application to many different location where a free standing whip antenna is required to be mounted.

As explained above, while the antenna is described as having two sections, it may have a single section or it may be in three or more sections or portions, joined together in essentially the same way as shown in connection with FIGS. 1 through 5.

The base effectively insulates the entire antenna, and the provision of the plurality of electrical connections on the metallic antenna itself permits electrical connections to be made at suitable points, so that while the antenna itself may be energized, the antenna is insulated from the vessel or other substrate on which the base is mounted.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A free standing antenna for use in association with high-stress environments for radiating or receiving radio wave transmissions, said environments subjecting said antenna to extremes of stress including flexing stress and temperature stress, and said antenna comprising;

an insulating, non-radiating mounting base member adapted to be secured adjacent to said high-stress environment , said base member being formed of glass fibre reinforced resin materials containing fibres extending in a longitudinal direction, along an axis of said base, and further fibres running in a generally annular fashion in planes generally transverse to said axis, and said base member further defining a fastening flange, and a plurality of fastening holes formed in said fastening flange;

an insulating non-radiating generally tapering neck portion formed of glass fibre reinforced resin extending upwardly from said fastening flange;

an insulating non-radiating generally cylindrical junction head formed of glass fibre reinforced resin and extending integrally upwardly from said tapering neck portion, said head and said neck portion being integral with said base member and located along a common central axis;

a metallic antenna column secured to said cylindrical head, said column being formed of hollow tubular metal defining outer and inner wall surfaces, and progressively tapering from a larger end to a smaller end;

a metallic cylindrical antenna junction at said larger end of said antenna column adapted to make a snug fit over said glass fibre reinforced resin cylindrical junction head of said base member;

at least three metallic electrical connection means secured to said metallic antenna column adjacent said larger end at spaced apart points along said column for attachment of electrical connections thereto from radio equipment;

a generally dome shaped cap secured to said smaller end of said column, and, a hollow cylindrical damping housing secured within said column adjacent to but spaced below said cap, said damping housing being located offset relative to the central axis of said antenna column.

2. A free standing antenna, as claimed in claim 1, wherein said column comprises at least two separate first and second column portions, each of said column portions defining respective larger lower ends and smaller upper ends, and said first column portion at its said smaller end defining a generally cylindrical column junction head, and said second column portion defining, at its said larger end, a generally cylindrical column junction sleeve adapted to make a snug fit over said column junction head, and, reinforcing ring means secured inside said column junction head at spaced apart intervals, and fastening opening means formed in said column junction sleeve in registration with said reinforcing rings, whereby fastenings may be passed therethrough and secured into said reinforcing rings, thereby joining said column two portions together.

3. A free standing antenna, as claimed in claim 1, and including an axial opening in said base member extending therealong from the top of said junction head, to said flange, and, drain conduit means formed in the underside of said flange, whereby liquid within said base member or said column may drain downwardly and outwardly therefrom.

4. A free standing antenna as claimed in claim 1 and including reinforcement ring means in said cylindrical head and fastening openings therethrough, whereby fastenings can be passed from said cylindrical junction at said larger end of said antenna column, and said cylindrical head of said base member, and through said reinforcement ring means.

5. A free standing antenna as claimed in claim 4 and wherein said reinforcing ring means comprises first and second reinforcing rings spaced apart from one another axially along the length of said cylindrical head, each of said reinforcing rings having fastening openings therethrough, and registering fastening openings in said cylindrical head, whereby fastenings can be passed therethrough.

6. A free standing antenna as claimed in claim 1 and including at least two collar members formed on the exterior of said base member, axially spaced therealong, on said neck portion, below said generally cylindrical

* * * * *